US007581651B2

(12) United States Patent
Matukawa et al.

(10) Patent No.: US 7,581,651 B2
(45) Date of Patent: Sep. 1, 2009

(54) METAL PILFER-PROOF CAP

(75) Inventors: Yosihiko Matukawa, Sagamihara (JP); Eiji Araki, Sagamihara (JP); Kunitosi Goto, Sagamihara (JP)

(73) Assignee: Daiwa Can Company, Tokyo (JP)

( * ) Notice: Subject to any disclaimer, the term of this patent is extended or adjusted under 35 U.S.C. 154(b) by 571 days.

(21) Appl. No.: 10/547,298

(22) PCT Filed: Feb. 28, 2003

(86) PCT No.: PCT/JP03/02334

§ 371 (c)(1),
(2), (4) Date: Aug. 29, 2005

(87) PCT Pub. No.: WO2004/076306

PCT Pub. Date: Sep. 10, 2004

(65) Prior Publication Data

US 2006/0169665 A1 Aug. 3, 2006

(51) Int. Cl.
*B65D 41/34* (2006.01)
*B65D 41/32* (2006.01)

(52) U.S. Cl. ..... 215/252; 215/258; 215/901

(58) Field of Classification Search ..... 215/252, 215/258, 253, 901
See application file for complete search history.

(56) References Cited

U.S. PATENT DOCUMENTS 3,235,115 A * 2/1966 Duke ..... 215/252
3,303,955 A * 2/1967 Osborne et al. ..... 215/252
3,348,718 A * 10/1967 Musy ..... 215/252
3,484,012 A * 12/1969 White et al. ..... 215/252
3,746,202 A * 7/1973 Moller ..... 215/253
3,750,821 A * 8/1973 Sourbet et al. ..... 215/252
3,767,077 A * 10/1973 Rhoades ..... 215/252
3,771,683 A * 11/1973 Dickey ..... 215/252
3,796,338 A * 3/1974 Wilton ..... 215/252
3,812,991 A 5/1974 Wurl
3,861,551 A * 1/1975 Hannon ..... 215/252
3,910,443 A * 10/1975 Hadley ..... 215/252

(Continued)

FOREIGN PATENT DOCUMENTS

JP 108553/1978 8/1978

(Continued)

*Primary Examiner*—Anthony D Stashick
*Assistant Examiner*—Niki M Eloshway
(74) *Attorney, Agent, or Firm*—Oblon, Spivak, McClelland, Maier & Neustadt, P.C.

(57) ABSTRACT

A metallic pilfer-proof cap, in which the skirt of a skirt portion of a cap can be so separated by a weakening portion having horizontal slits and bridges formed alternately in the circumferential direction of the cap that the skirt may be left in a ring shape as a pilfer-proof band on the side of a container mouth. The horizontal slits formed by shearing in the transverse direction from the outside to leave the bridges are offset radially more inward of the cap at the portion above a shearing plane than at the portion below the shearing plane so that the bridges are formed on the upper side of the shearing plane of the horizontal slits. The upper end portion, as located on the lower side of the shearing plane, of the pilfer-proof band is made to have an internal diameter larger than the maximum external diameter of the annular bulging portion which is formed at the container mouth for retaining the pilfer-proof band.

4 Claims, 15 Drawing Sheets

U.S. PATENT DOCUMENTS 3,966,071 A 6/1976 Northup
4,205,755 A 6/1980 De Wijn
4,217,989 A * 8/1980 George ..... 215/253
4,519,516 A * 5/1985 Amos ..... 215/252
4,823,537 A 4/1989 Duke
5,405,032 A * 4/1995 Anderson ..... 215/252

FOREIGN PATENT DOCUMENTS

JP 61-175144 10/1986

* cited by examiner

METAL PILFER-PROOF CAP

TECHNICAL FIELD

The present invention relates to a metallic cap, which has a pilfer-proof (or tamper-evidence) function to inform a consumer of the fact that the cap was once opened. Specifically, the invention relates to a metallic pilfer-proof cap which leaves, when opened, a pilfer-proof band in a ring shape on the side of the container mouth and, more particularly, to a structure for such a weakening portion of the pilfer-proof band as is formed at the skirt of the cap.

BACKGROUND ART

The metallic cap having the so-called "pilfer-proof (or tamper-evidence) function" is employed widely and generally in various beverage containers or the like in the prior art. In this pilfer-proof function, the weakening portion of the pilfer-proof band formed at the bottom of the skirt portion of the cap is ruptured, when the cap is removed (by turning it counter-clockwise, for example) for the first time to open the container, so that the opening of the container may be clearly indicated to prevent a tampering use. The cap of this kind is divided into a plurality of types according to the difference in the structure for rupturing the pilfer-proof band. In one type of such metallic pilfer-proof cap (as abbreviated into the "PP cap"), a plurality of slits formed at a predetermined circumferential interval in the skirt portion and a plurality of bridges positioned between the slits are not ruptured when the cap is turned and removed.

There is also known a type (or Type 1), in which a plurality of vertical scores are formed at a predetermined interval in the bottom of the skirt portion and extended perpendicularly of the horizontal slits. The vertical scores formed to reach the slits from the positions spaced at a predetermined distance from the lower end of the skirt portion. The vertical scores are ruptured by turning the cap screwed on the container mouth.

In another known type (or Type 2), there are formed wider bridges, in which vertical scores are directed in the directions perpendicular to the horizontal slits, and other bridges which can be ruptured more easily than those wider bridges. When this cap of Type 2 is turned and removed from the container mouth, the bridges other than the wider bridges are ruptured at first, and the vertical scores formed in the wider bridges are then ruptured. As a result, the pilfer-proof band is cut into an open state so that it is removed together with the cap from the container mouth. Here, one vertical score is formed from the position at a predetermined spacing from the lower end of the skirt portion to the slit circumferential portion.

There is further known a cap of the type (or Type 3), in which all the narrower bridges are broken, when the cap is turned and removed, so that the pilfer-proof band cut off the cap is left in the ring shape on the side of the container mouth.

The first one of the aforementioned three types is disclosed not only in the specification of U.S. Pat. No. 3,771,683 but also in the specifications of U.S. Pat. Nos. 3,812,991, 3,861,551 and 4,217,989.

The pilfer-proof cap of the aforementioned first type is moved upward as it is turned counter-clockwise. However, the upward movement of the pilfer-proof band is blocked by the annular bulging portion of the container mouth. Therefore, the vertical scores formed in the skirt portion are ruptured to widen the bottom of the skirt portion, and this widened skirt portion can ride over the annular bulging portion so that the cap can be removed from the container mouth.

Therefore, the pilfer-proof cap of this type is advantageous in that it can be judged in view of the appearance of the ruptured and widened vertical scores of the skirt portion whether or not the cap has been once opened.

In the cap of this type, however, the vertical scores formed in the skirt portion are ruptured to expose their shape ruptured faces to the outside, and may injure the hand or the like of a consumer.

Moreover, the bottom of the skirt portion is ruptured and widened along the vertical scores so that the appearance gives a poor looking. The skirt portion ruptured along the vertical scores is an obstacle, and the consumer may separate the skirt portion from the cap body and may throw it to the places other than the garbage pit. This raises a problem of scattering the garbage. Even if the bottom of the skirt portion is removed from the cap body, the residues of the bridges may be left on the end portion of the cap skirt to injure the hand or the like of the consumer.

Thus, a second type has been conceived and disclosed in the specification of U.S. Pat. No. 4,205,755.

In the pilfer-proof cap of this second type, the cap is moved upward by turning the cap counter-clockwise, but the pilfer-proof band is retained and prevented from upward movement by the annular bulging portion of the container mouth. Consequently, ruptures occur at bridges other than one wide bridge and then at the vertical scores in the wide bridge so that the pilfer-proof band is ruptured. As a result, the pilfer-proof band can be removed together with the cap from the container mouth.

Therefore, the pilfer-proof cap of this type is advantageous in that its once opening can be judged from the appearance even if it is closed again, because all the bridges other than the wide bridge are ruptured together with the vertical scores when the cap is once opened.

However, the pilfer-proof band still attached in the ruptured state to the cap raises an obstacle, and the pilfer-proof band in the ruptured state may be cut off the body portion of the cap and discarded to a place other than the garbage pit. This discard raises a cause for scattering the garbage. Moreover, the fingers or the like may be injured when the pilfer-proof band is torn off the body portion of the cap.

A cap of a third type is disclosed in Japanese Utility Model Laid-Open No. 61-175144. In the pilfer-proof cap of this type 3, the cap is moved upward by turning it counter-clockwise, but the upward movement of the pilfer-proof band is blocked by the annular bulging portion of the container mouth. Therefore, all the narrow bridges of the pilfer-proof band are ruptured so that the pilfer-proof band cut off the cap is left in the ring shape on the container mouth.

According to the cap of this type 3, therefore, the problem of scattering the garbage or the like can be solved. Therefore, the cap of the type 3 is superior because it can solve the problems intrinsic to the caps of the remaining two types.

Here, the metallic pilfer-proof cap having the pilfer-proof band at the bottom of the skirt portion is mounted, no matter what type it might belong to, on the container mouth by employing the well-known metallic cap rolling apparatus. Specifically, the cap is rolled on, while being loaded (as a top load) on its top end wall, by the individual shaping rolls of that apparatus, so that the cylindrical portion of the skirt portion is deformed and internally threaded according to the external thread of the container mouth. At the same time, the lower end portion of the pilfer-proof band, which is formed at the bottom of the skirt portion, is rolled to engage with the lower end portion of the annular bulging portion of the container mouth.

On the other hand, the description is made on the container mouth to be crowned with the cap of the third type. This container mouth is usually provided, below the externally threaded area, with the annular bulging portion for retaining the pilfer-proof band and, below this annular bulging portion, with the diametrically smaller cylindrical portion having a diameter substantially equal to that of the root of the external thread. This container mouth of the most popular shape is crowned with the cap, as described above. When the cap is to be removed for the first time from the container mouth to open the container by turning it counter-clockwise, the cap itself is moved upward, but the pilfer-proof band is prevented from moving upward by the annular bulging portion of the container mouth. As a result, the weakening portion of the pilfer-proof band is ruptured so that the pilfer-proof band is separated from the cap.

Here in the metallic pilfer-proof cap of the prior art, as disclosed in Japanese Utility Model Laid-Open No. 61-175144, the horizontal slits are formed along the circumferential direction of the cap in a manner to leave the bridges so that the bottom of the skirt portion may be the pilfer-proof band. In this case, the horizontal slits are formed by a slit punch tool, which is provided with shearing blades at a predetermined narrow interval on the outer edge in the circumferential direction, excepting the bridge portions. Specifically, as shown in FIG. 13, by employing a slit punch tool 34B providing an upper face side with a shearing plane normal to the cap wall and a lower face with a slope face, horizontal slits 16 are formed to offset (or displace) the lower side of a shearing plane X radially more inward of the cap than the upper side, as shown in FIG. 12B. Moreover, the portions having no shearing blade of the slit punch tool 34B leave the portions connected by bridges 17B, as shown in FIG. 12A. (Here, the concept of vertical directions accords to the vertical directions of the cap.)

Here is examined the metallic pilfer-proof cap of the prior art type, in which the pilfer-proof band is left on the side of the container mouth when the cap is opened. In this case, a container mouth 2 is crowned with a cap 1, as shown in FIG. 14A and FIG. 14B, from the unused state shown in FIG. 11, by the rolling-on operation. When the cap 1 is then removed for the first time from the container mouth 2 to open the container by turning the cap 1 counter-clockwise, the pilfer-proof band 15 left at the container mouth 2 is caught at its upper end by the container mouth 2, because the pilfer-proof band 15 is offset near its upper end inward at the time of forming the horizontal slits so that it is pushed onto the side of the container mouth 2. As a result, the pilfer-proof band 15 does not slip down naturally but is fixed at its mounted position. When, however, the container mouth 2 is re-sealed with the cap 1 once removed, the cap 1 merges into the pilfer-proof band 15 left on the container mouth 2, as shown in FIG. 15B. At a glance, therefore, it is not easily found that the container has already been opened. This may fail to provide the pilfer-proof effect sufficiently.

Moreover, the bridges 17B formed between the horizontal slits 16 are located on the lower side of the shearing plane of the horizontal slits 16. When the bridges 17B are ruptured to cut the pilfer-proof band 15 off the cap 1, the residues (i.e., relatively large ruptured pieces) of the bridges 17B are left on the side of the pilfer-proof band 15, which is left in a ring shape on the container mouth 2. As a result, the lips or the like of the consumer may be injured by the residues of the bridges 17B left on the side of the pilfer-proof band 15, when the consumer drinks the beverage with his or her mouth directly from the container mouth 2.

The present invention has an object to solve the problems thus far described. The specific object of the invention is to provide a metallic pilfer-proof cap of the type, in which a pilfer-proof band is left in a ring shape on the side of a container mouth. According to the invention, the pilfer-proof band once cut off the cap is not placed in the original cap-mounted state on the side of the container mouth thereby to provide the pilfer-proof effect sufficiently. Moreover, the safety at the using time can be retained by clearing the side of the pilfer-proof band cut off the cap, of the residues of the bridges.

DISCLOSURE OF THE INVENTION

In order to solve the above-specified problems, according to the invention, there is provided a metallic pilfer-proof cap, in which the bottom of a skirt portion of a cap can be so separated by a weakening portion having horizontal slits and bridges formed alternately in the circumferential direction of the cap that the bottom of the skirt portion may be left in a ring shape as a pilfer-proof band on the side of a container mouth. The pilfer-proof cap is characterized: in that the horizontal slits formed by shearing in the transverse direction from the outside to leave the bridges are offset radially more inward of the cap on the upper side of a shearing plane than on the lower side of the shearing plane so that the bridges are formed above the shearing plane of the horizontal slits; and in that the upper end portion, as located on the lower side of the shearing plane, of the pilfer-proof band is made to have an internal diameter larger than the maximum external diameter of the annular bulging portion which is formed at the container mouth for retaining the pilfer-proof band.

Therefore, the pilfer-proof band, which is left on the container mouth when it is cut off the cap at the rupture of the bridges, naturally slips down by its own weight while being caught at its upper end portion by the annular bulging portion of the container mouth, so that it is not left as it is at its original mounted position on the container mouth. Moreover, the residues of the bridges are left on the side of the cap but hardly on the side of the pilfer-proof band. Therefore, the consumer is hardly injured at his or her lips or the like by the pilfer-proof band left on the side of the container mouth, when he or she drinks the beverage directly from the container mouth.

If the portion of the cap above the bridges is made to have an upper bead portion of a larger diameter than the external diameter of the weakening portion including the bridges, the residues of the bridges left on the cap side are concealed under the upper bead portion. As a result, the bridge residues are kept away from the direct touch of the fingers or hand of the consumer or from the heavy cap gripping load, so that they do not injure the fingers or hand.

By making the bridge height of the cap substantially equal to or smaller than the sheet thickness, moreover, the bridge residues to be left on the cap are reduced to cause no injury of the fingers gripping the cap.

If, moreover, the bridge height of the cap is made substantially equal to or smaller than the sheet thickness and made larger than 0.07 mm, the bridge residues to be left on the cap are substantially eliminated to cause no injury of the fingers gripping the cap. In the slit shaping case, moreover, there is either a method, in which the slits are shaped by revolving the cap around a fixed slit punch (i.e., a mold for shaping the slits) while rotating on its axis, or a method, in which the slits are shaped by rotating the cap on its axis together with the rotating slit punch. In this method, no aluminum hair is produced to give a good appearance, even if the cap fluctuates more or less.

BEST MODE FOR CARRYING OUT THE INVENTION

Figure 1:
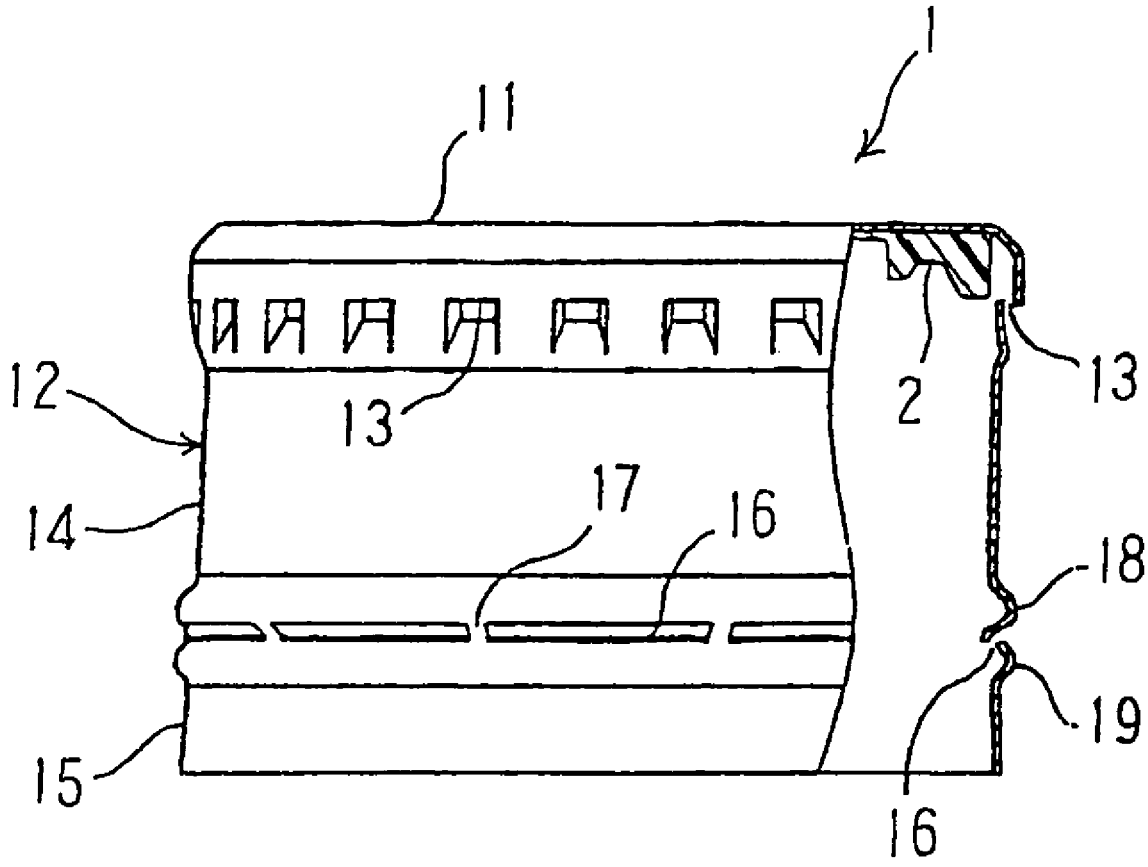
FIG. 1 is a partially cut-away side elevation showing one example of a metallic pilfer-proof cap of the invention in its unused state before mounted on a container mouth.
Figure 2A:
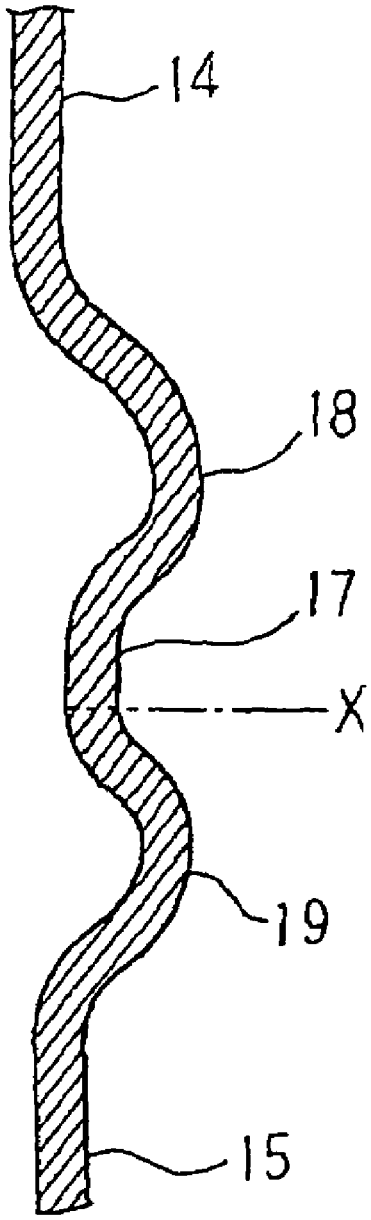
FIG. 2A is an enlarged section of the portion of a bridge in the cap shown in FIG. 1.
Figure 2B:
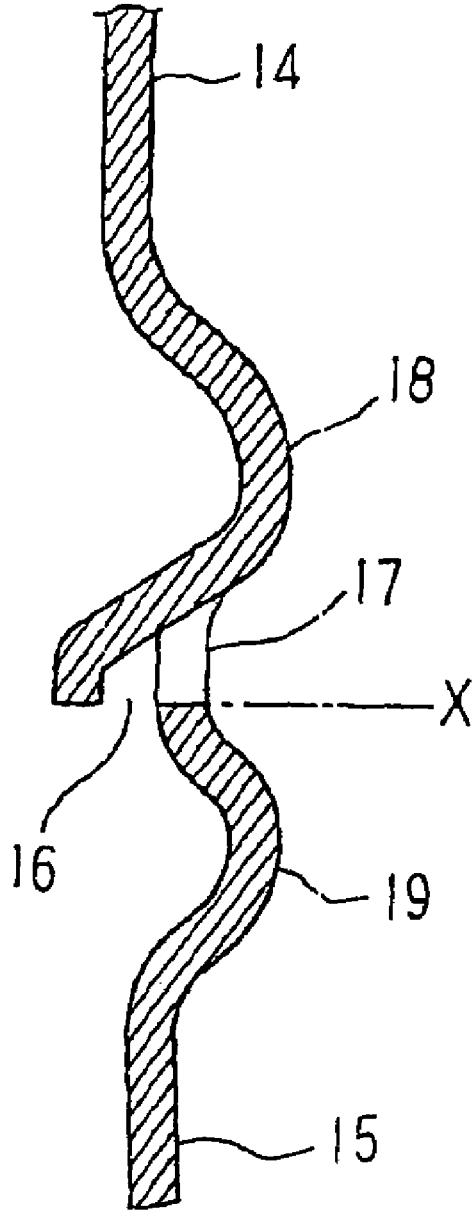
FIG. 2B is an enlarged section showing the portion of a horizontal slit in the cap shown in FIG. 1.
Figure 3:
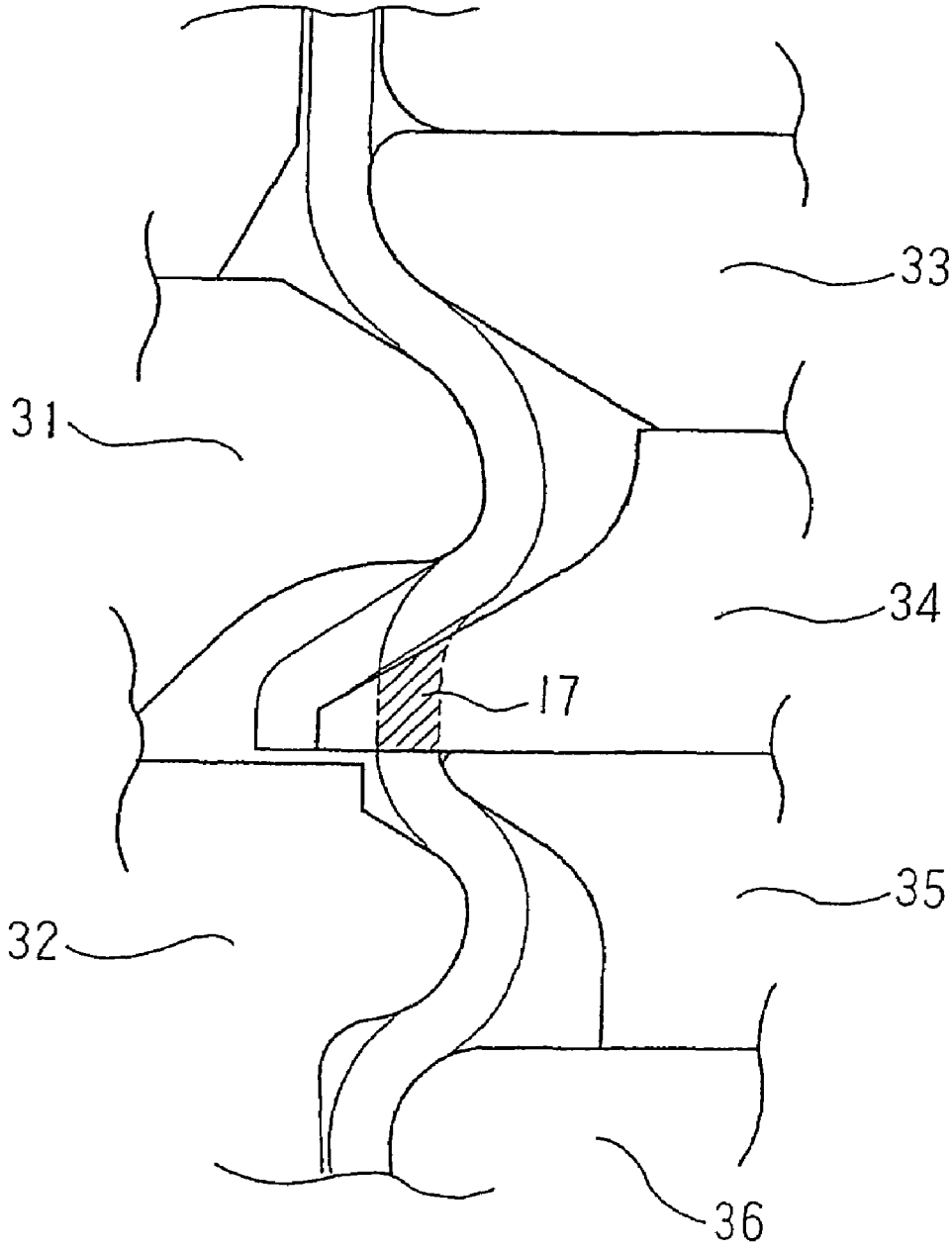
FIG. 3 is an explanatory longitudinal section showing the state, in which the vicinity of a weakened portion in the cap shown in FIG. 1 is shaped by a cap shaping apparatus.
Figure 4A:
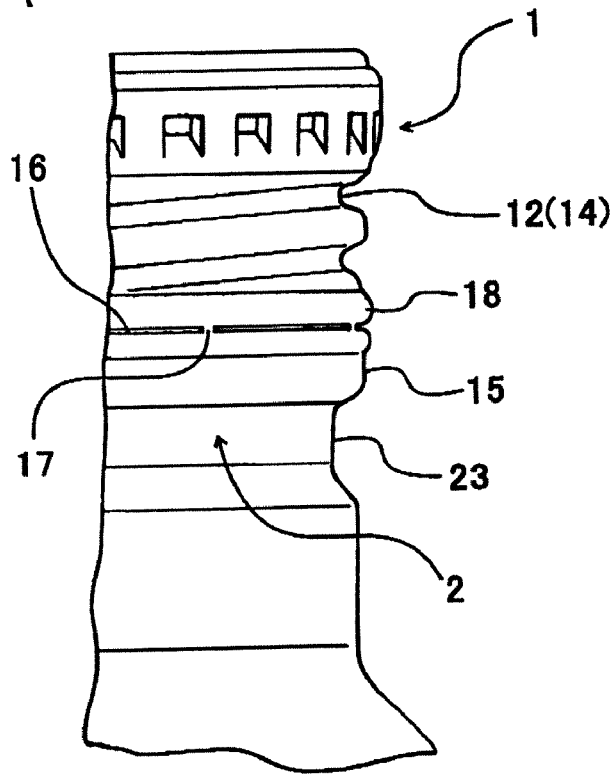
FIG. 4A is a side elevation partially showing the state, in which the cap shown in FIG. 1 is mounted on the container mouth but not opened yet.
Figure 4B:
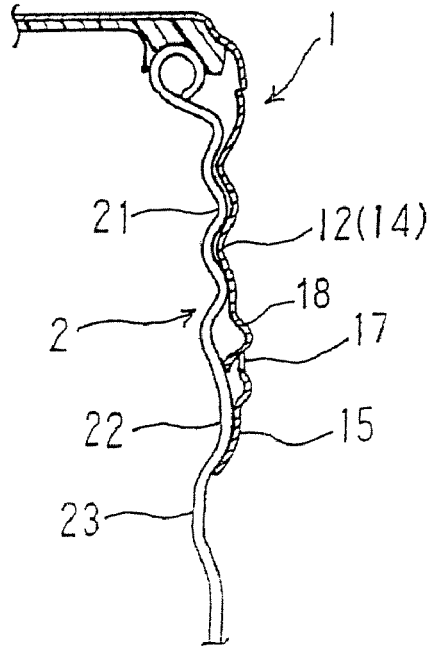
FIG. 4B is a longitudinal section of the same.
Figure 5A:
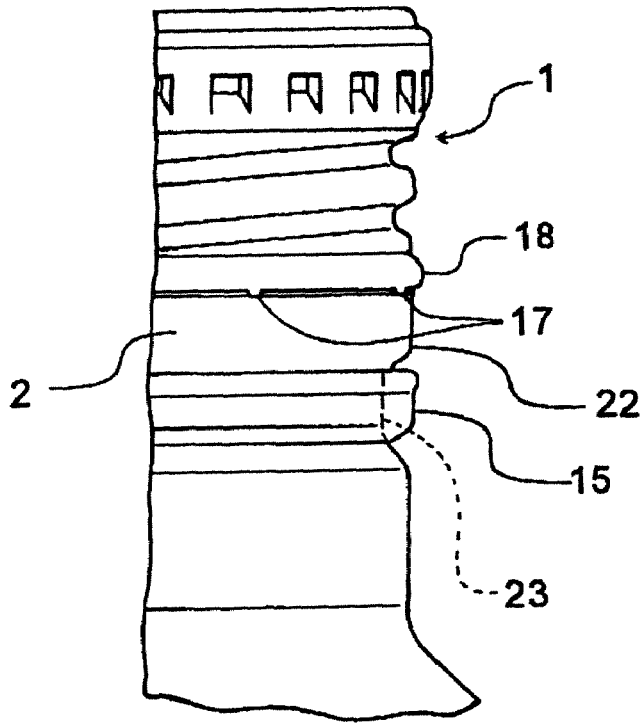
FIG. 5A is a side elevation partially showing the state, in which the container mouth is sealed with the cap shown in FIG. 1.
Figure 5B:
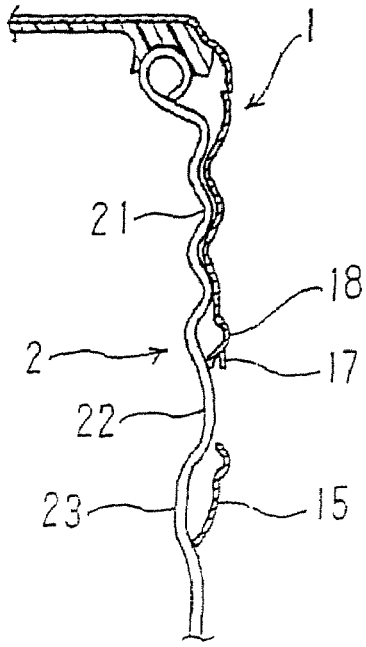
FIG. 5B is a longitudinal section of the same.
Figure 15A:
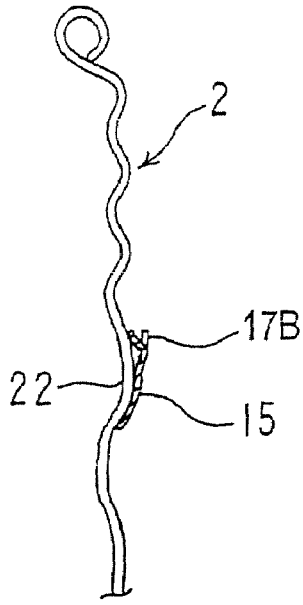
FIG. 15A is a side elevation partially showing the state, in which the container mouth is sealed again with the cap of the prior art shown in FIG. 11.
Figure 15B:
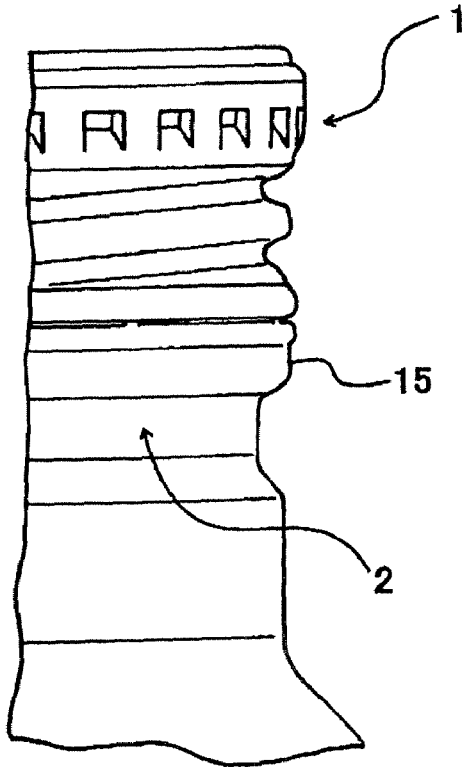
FIG. 15B is a longitudinal section of the same.

A specific example of the metallic pilfer-proof cap of the invention will be described in detail with reference to the accompanying drawings. In connection with the specific example of the invention: FIG. 1 shows an unused cap before mounted on the container mouth; FIG. 2A shows the bridge portion of the unused cap; FIG. 2B shows the horizontal slit portion; FIG. 3 shows the shaped states of the horizontal slit and the bridge; FIG. 4A and FIG. 4B show the unopened state, in which the cap is mounted on the container mouth; and FIG. 5A and FIG. 5B show the re-sealed state, in which the container mouth opened is sealed again with the cap. In connection with the metallic pilfer-proof cap of the prior art, on the other hand: FIG. 11 to FIG. 14 correspond to FIG. 1 to FIG. 4; FIG. 15A shows the pilfer-proof band which was cut off the cap and left on the side of the container mouth; and FIG. 15B shows the state the container mouth opened is sealed again with the cap.

In this specific example, a metallic pilfer-proof cap 1 has a packing 2 of a resin adhered to the lower side of a top end wall 11, as shown in FIG. 1. In the unused state before mounted on the mouth of a container body, the cap 1 has a generally cylindrical skirt portion 12 depending downward from the circumferential edge of the top end wall 11 through a bulging portion. In the bulging portion near the upper end of the skirt portion 12, there are formed vent slits 13 for venting gases when the cap 1 is used with either a carbonated beverage container or a container of the type, in which liquid nitrogen is added to the inside of the container immediately before the container mouth is sealed. Below the vent slits 13, there is formed a cylindrical portion 14, which is scheduled to be internally threaded.

At the lower portion below the cylindrical portion 14 of the skirt portion 12, moreover, there is provided a pilfer-proof band 15. This pilfer-proof band 15 is so formed by a weakening portion, in which horizontal slits 16 and bridges 17 are alternately formed in the circumferential direction, as can be separated from the cap body portion. The upper side of the weakening portion by the horizontal slits 16 and the bridges 17 provides an annular upper bead portion 18 protruding outward, and the lower side of the weakening portion provides an annular lower bead portion 19 protruding outward. When the pilfer-proof band 15 is cut off at the skirt portion 12 of the cap 1, the upper bead portion 18 becomes the lower end portion of the cap 1 (i.e., the cap body portion), and the lower bead portion 19 becomes the upper end portion of the pilfer-proof band 15.

The unused cap 1 is not internally threaded in the cylindrical portion 14 of the aforementioned skirt portion 12. The well-known rolling apparatus is employed for the metallic cap, which is mounted on the container mouth. The cap 1 is rolled on, while being loaded on its top end wall 11, by the individual shaping rolls of that apparatus, so that the cylindrical portion 14 of the skirt portion 12 is deformed and internally threaded according to the external thread of the container mouth. At the same time, the bottom end portion of the pilfer-proof band 15, which is formed at the skirt of the skirt portion 12, is rolled (or bent radially inward) to engage with the lower end portion of the annular bulging portion of the container mouth.

As a result, a container mouth 2 has an annular bulging portion 22 formed below the area having an external thread 21 for retaining the pilfer-proof band 15, and a diametrically smaller cylindrical portion 23 formed to have a diameter substantially equal to that of the root of the external thread 21, as shown in FIG. 4A and FIG. 4B. The skirt portion 12 (originated from the cylindrical portion 14) of the cap 1 is internally threaded so that the container mouth 2 is mounted on the cap 1 with the lower end portion of the pilfer-proof band 15 engaging with the lower end portion of the annular bulging portion 22.

When the cap 1 thus mounted on the container mouth 2 is turned for opening the container in the direction to be released from the engagement with the container mouth 2, the bridges 17 of the weakening portion are ruptured to cut the pilfer-proof band 15 off the cap 1 (or the cap body portion). As a result, the cap 1 (or the cap body portion) is removed from the container mouth 2 while leaving the pilfer-proof band 15 engaging with the lower end portion of the annular bulging portion 22 of the container mouth 2, on the side of the container mouth 2. In case the container mouth 2 is re-sealed with the cap 1 after the beverage in the container was drunken, as shown in FIG. 5A and FIG. 5B, the pilfer-proof band 15 has slipped down from its original position. The lower end of the cap 1 and the upper end of the pilfer-proof band 15 are spaced by a distance substantially equal to the height size of the diametrically smaller cylindrical portion 23. This appearance makes it clear that the container has already been opened.

Incidentally, the shaping treatments of the vent slits 13, the horizontal slits 16 (or the bridges 17), the individual bead portions 18 and 19 and so on are basically carried out, although not shown, by employing the cap shaping apparatus having a structure well-known in the art. By this apparatus, the cap is shaped by revolving thereon the roll head mounted on the cap while rotating the same, along a punch tool having a cap abutting face extending in the circumferential direction.

Figure 13:
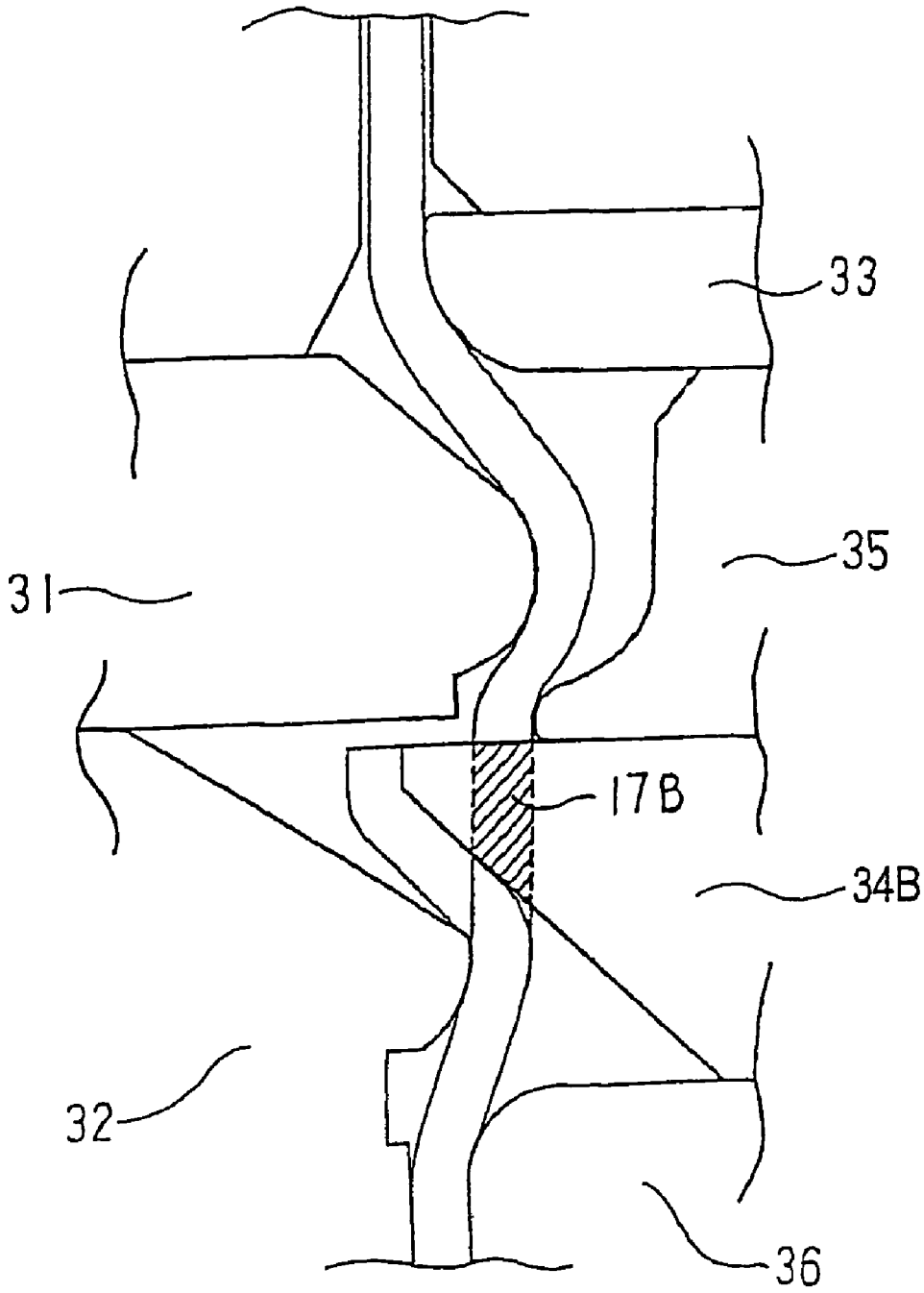
FIG. 13 is an explanatory longitudinal section showing the state, in which the vicinity of a weakened portion in the cap shown in FIG. 11 is shaped by a cap shaping apparatus.
Figure 14A:
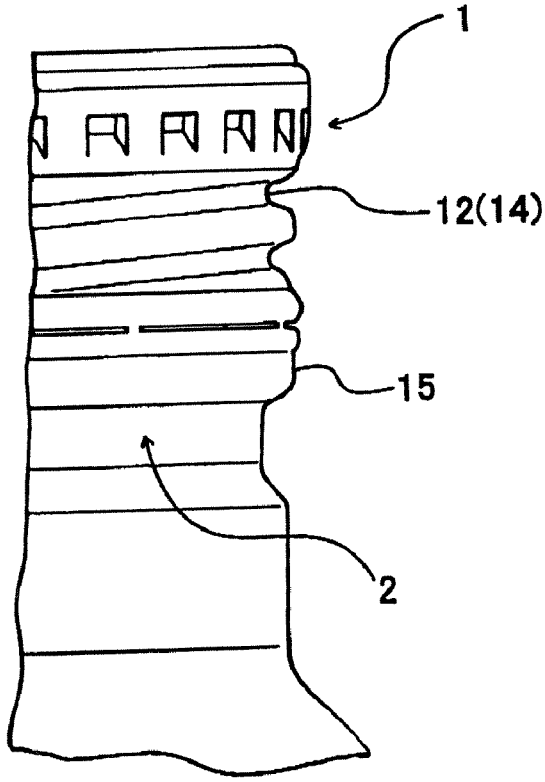
FIG. 14A is a side elevation partially showing the state, in which the cap of the prior art shown in FIG. 11 is mounted on the container mouth but not opened yet.
Figure 14B:
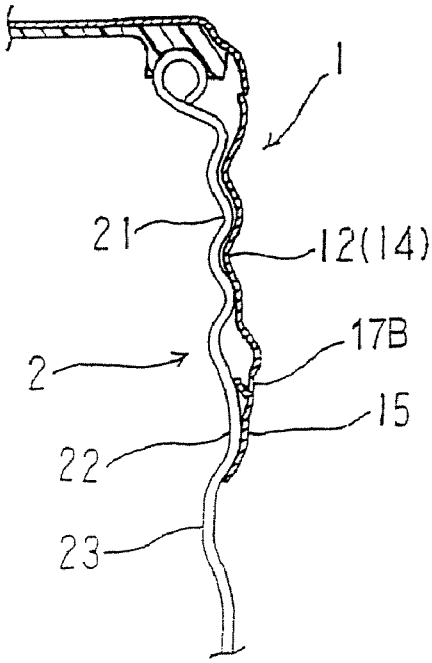
FIG. 14B is a longitudinal section of the same.

This cap shaping apparatus shapes the vicinity of the weakening portion for separating the pilfer-proof band 15 from the skirt portion 12 (or the cap body portion). For this operations, the apparatus of the prior art is equipped, on the side of the roll head, with a bead roll 31 and a pilfer-proof band roll 32 and, on the side of the punch tool, with a bead punch tool 33, a slit punch tool 34B, a bead support tool 35 and a pilfer-proof band tool 36, as shown in FIG. 13. The apparatus forms the horizontal slits 16 by transverse shearing actions from the outside with shearing blades formed at the leading edges of the slit punch tool 34B.

Moreover, portions having no shearing blade (i.e., the portions notched at the leading edges) are formed at an interval along the circumferential direction of the outer edge of the slit punch tool 34B. As a result, bridges 17B are left by the portions having no shearing blade between the horizontal slits 16, which are formed by the shearing blades at the leading edges of the slit punch tool 34B. At the time of shaping the weakening portion of those horizontal slits 16 and bridges 17B, moreover, the upper bead portion 18 is formed by the bead roll 31 on the upper side of the sheared face, and the lower bead portion 19 is formed by the pilfer-proof band roll 32 on the lower side of the sheared face.

Figure 12A:
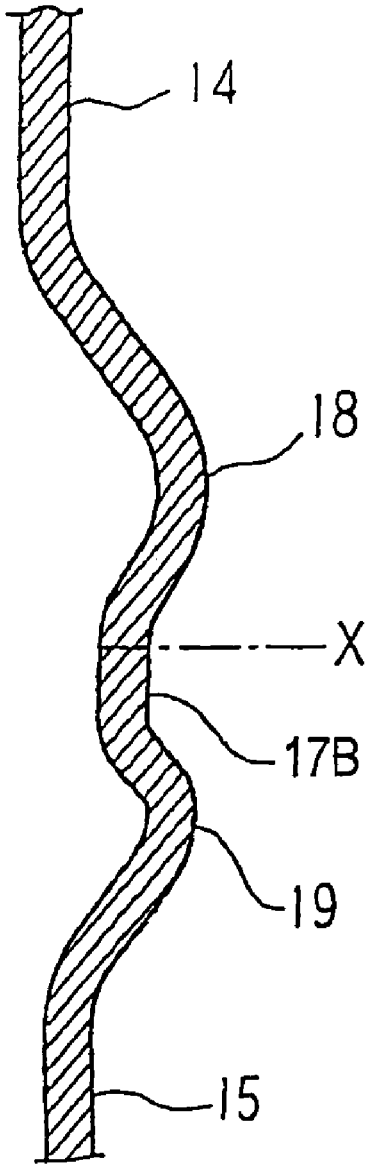
FIG. 12A is a longitudinal section of the portion of a bridge in the cap of the prior art shown in FIG. 11.
Figure 12B:
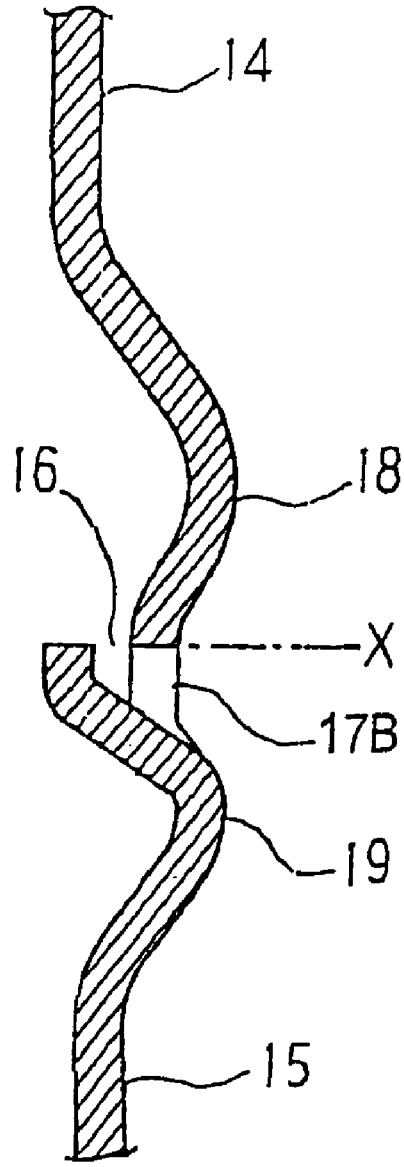
FIG. 12B is a longitudinal section showing the portion of a horizontal slit of the same.

In the formation of the vicinity of that weakening portion, the hatched portion is left in the prior art as the bridges 17B, as shown in FIG. 13, by employing the slit punch tool 34B providing an upper face side with the shearing plane normal to the cap wall and a lower face with a slope face. As a result, the horizontal slits 16 are formed to offset the lower side of a shearing plane X radially more inward of the cap than the upper side, as shown in FIG. 12B, and the bridges 17B are formed on the lower side of the shearing plane X, as shown in FIG. 12A. At the time of cutting off the pilfer-proof band 15, therefore, the bridges 17B are ruptured along the shearing plane X.

In this specific example, on the contrary, the hatched portion is left as the bridges 17, as shown in FIG. 3, by employing a slit punch tool 34 providing the lower face side with the shearing plane normal to the cap wall and the upper face with the slope face. As a result, the horizontal slits 16 are formed to offset the upper side of the shearing plane X radially more inward of the cap than the lower side, as shown in FIG. 2B, and the bridges 17 are formed on the upper side of the shearing plane X, as shown in FIG. 2A. At the time of cutting off the pilfer-proof band 15, therefore, the bridges 17 are ruptured along the shearing plane X.

According to the metallic pilfer-proof cap 1 of this specific example thus manufactured, the upper side of the shearing plane is offset radially inward of the cap (that is, the upper end of the lower bead portion 19 is positioned at a position outer than that of the lower end of the upper bead portion 18) at the time of forming the horizontal slits 16. As a result, the upper end portion, as located on the lower side of the shearing plane, of the pilfer-proof band 15 is made to have an internal diameter slightly larger than the maximum external diameter of the annular bulging portion 22 of the container mouth 2. As a result, the pilfer-proof band 15 cut off the cap 1 is not caught at its upper end portion by the annular bulging portion 22 of the container mouth 2.

As shown in FIG. 5A and FIG. 5B, therefore, the pilfer-proof band 15, which has been cut off the cap 1 but left on the side of the container mouth 2, is not left as it is at its original mounted position on the container mouth 2 but slides down by its own weight to the lower end of the diametrically smaller cylindrical portion 23 which is formed below the annular bulging portion 22. As a result, when the container mouth 2 is sealed again, after once opened, by turning the cap 1, a large clearance is formed between the pilfer-proof band 15 left on the side of the container mouth 2 and the re-sealing cap 1, so that everybody can know it at a glance that the container was opened.

Moreover, the bridges 17 are formed on the upper side of the shearing plane X of the horizontal slits 16. When the container is opened to cut the pilfer-proof band 15 off the cap 1, the residues of the bridges 17 are left on the side of the cap 1 but little on the side of the pilfer-proof band 15, as shown in FIG. 5A and FIG. 5B. Therefore, the consumer is hardly injured at lips or the like, when he or she drinks the beverage directly through his or her mouth from the container mouth 2, by the pilfer-proof band 15 which might otherwise be left on the side of the container mouth 2.

Moreover, the residues of the bridges 17 to be left on the side of the cap 1 by separating the pilfer-proof band 15 are enabled as much as possible by the outward protrusion of the annular upper bead portion 18 above the bridges 17 to prevent the fingers touching the cap 1 from coming into contact with the residues of the bridges 17.

Figure 6:
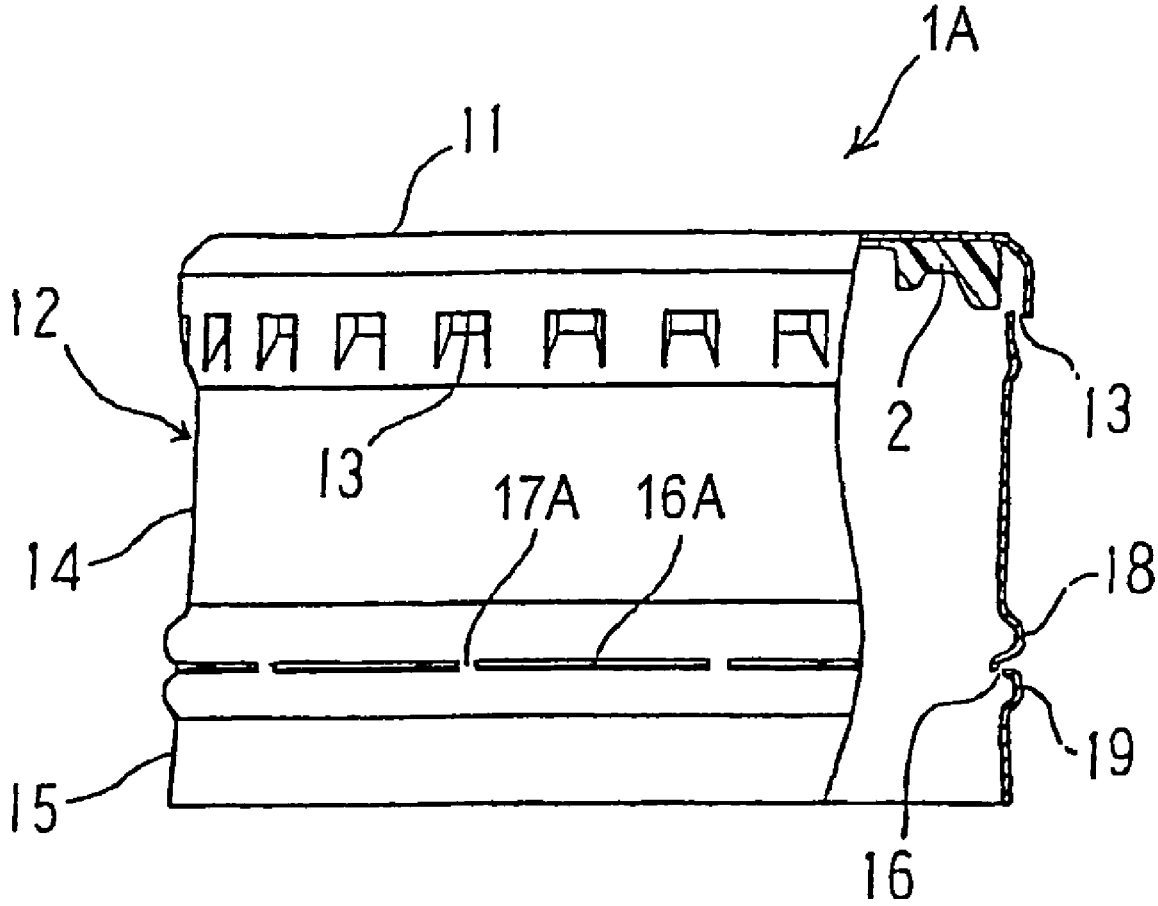
FIG. 6 is a partially cut-away side elevation showing another example of a metallic pilfer-proof cap of the invention in its unused state before mounted on a container mouth.
Figure 7A:
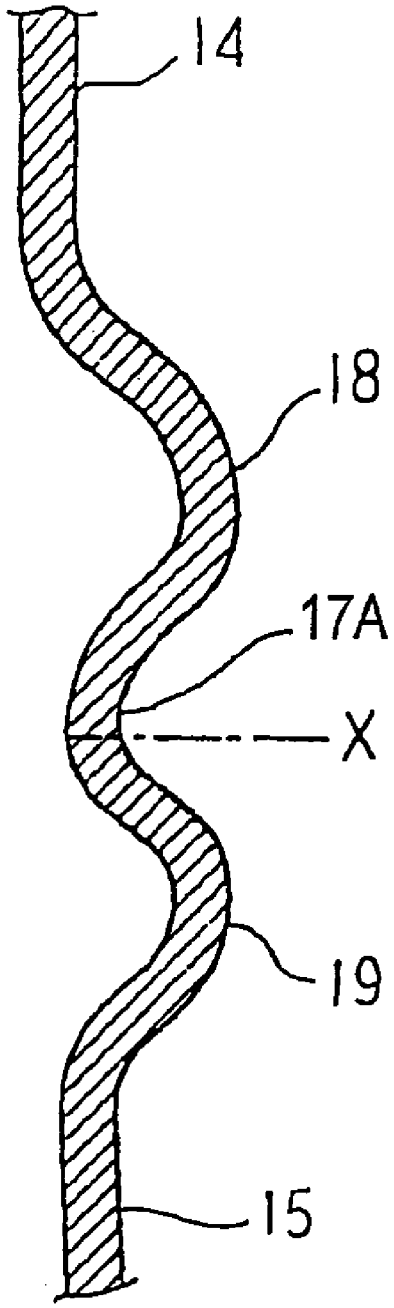
FIG. 7A is an enlarged section of the portion of a bridge in the cap shown in FIG. 6.
Figure 7B:
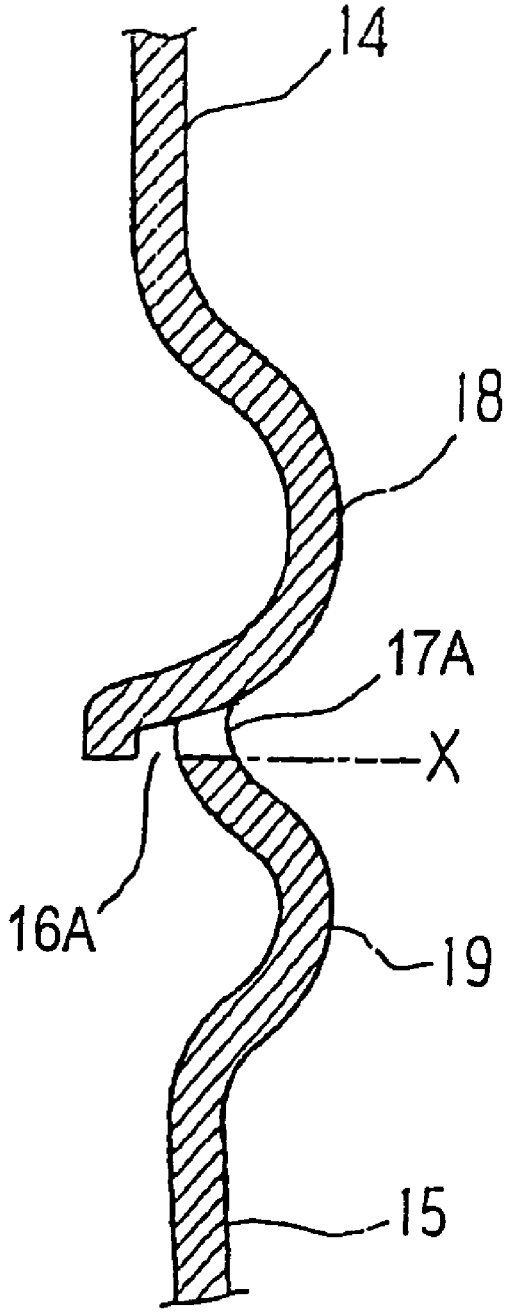
FIG. 7B is an enlarged section showing the portion of a horizontal slit in the cap shown in FIG. 6.

Another example of the cap according to this invention is described with reference to FIG. 6 to FIG. 10. In addition to the structure of the aforementioned specific example, the cap 1 shown in FIG. 6 is constructed such that bridges 17A are made to have a height substantially equal to or smaller than that of the cap 1 and a height of 0.07 mm or more. Accordingly, horizontal slits 16A are made to have an opening width (i.e., a width measured vertically of the cap 1) smaller than that of the horizontal slits 16 in the cap 1 shown in FIG. 1. This detail is shown in FIG. 7B. On the other hand, FIG. 7A shows the state before the shearing treatment.

Figure 8:
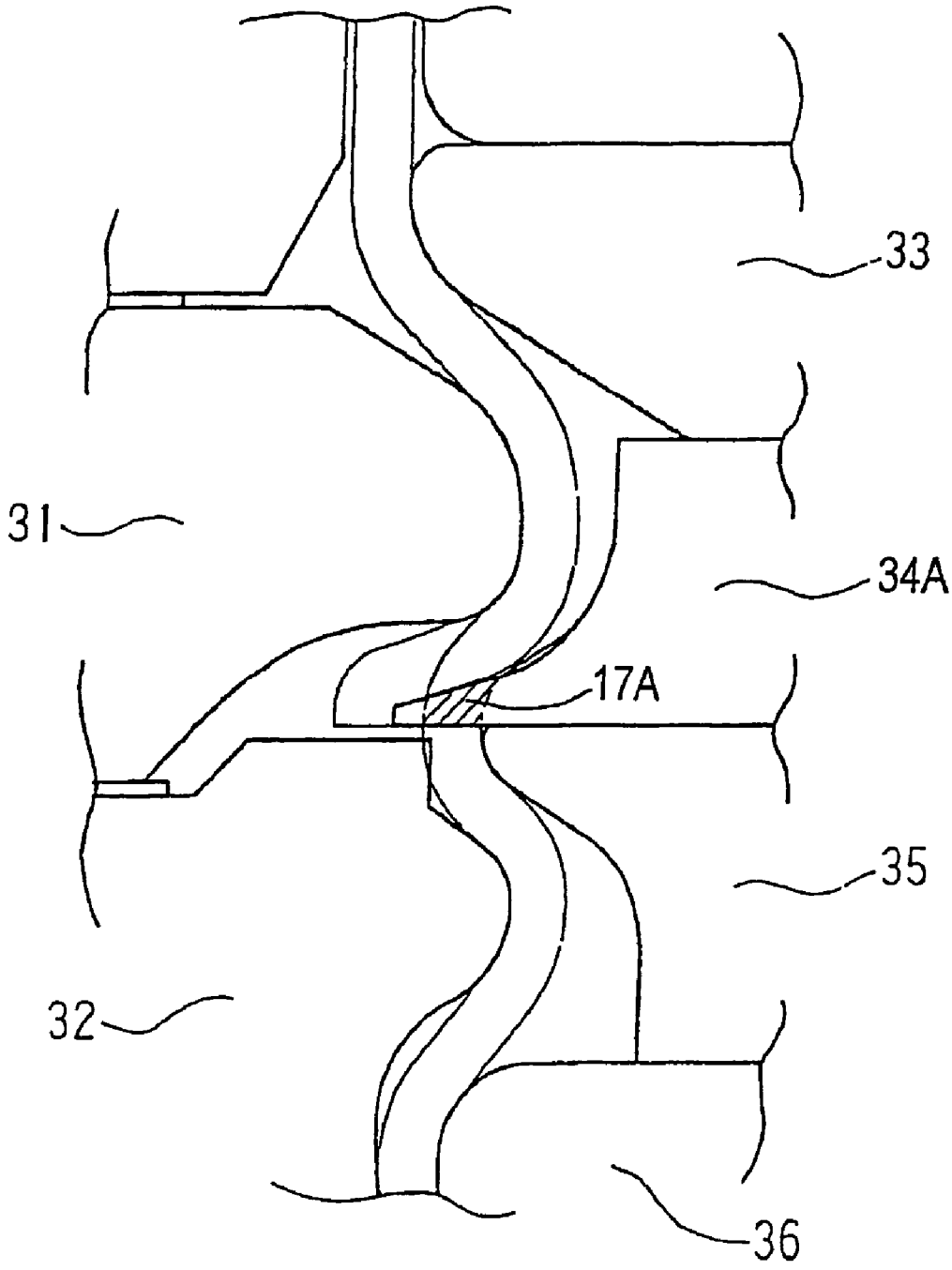
FIG. 8 is an explanatory longitudinal section showing the state, in which the vicinity of a weakened portion in the cap shown in FIG. 6 is shaped by a cap shaping apparatus.

These bridges 17A and horizontal slits 16A can be formed by employing a slit punch tool 34A having a shape shown in FIG. 8. Specifically, the slit punch tool 34A shown in FIG. 8 has a leading edge keener and thinner for the shearing blade than those of the slit punch tool 34B of the prior art shown in FIG. 13 and the slit punch tool 34 shown in FIG. 3. By employing that slit punch tool 34A, the width between the shearing plane on the lower face side and the slope face on the upper face side is extremely narrowed, as shown in FIG. 8. As a result, the height of the bridges 17A to be formed on the upper side of the shearing plane is substantially equal or smaller than the sheet thickness, as shown by a hatched portion.

Figure 9A:
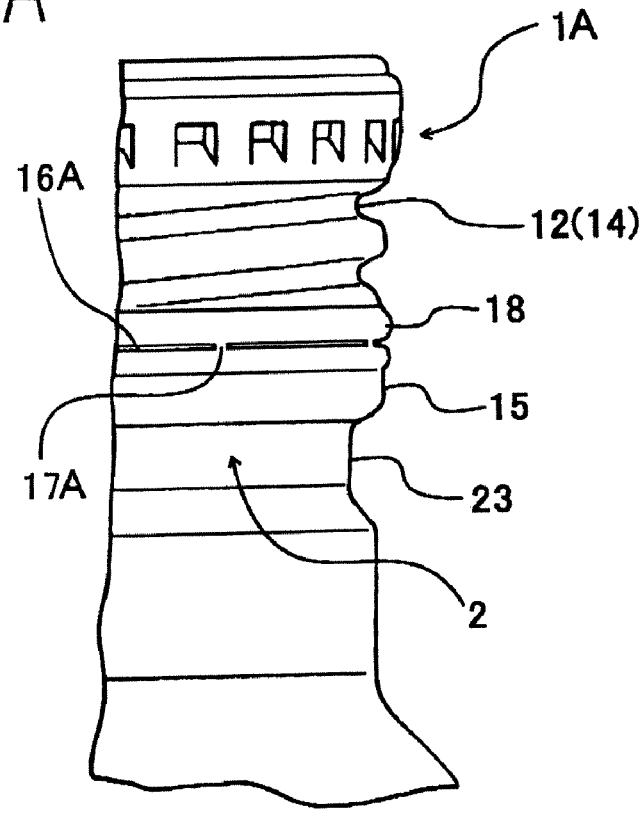
FIG. 9A is a side elevation partially showing the state, in which the cap shown in FIG. 6 is mounted on the container mouth but not opened yet.
Figure 9B:
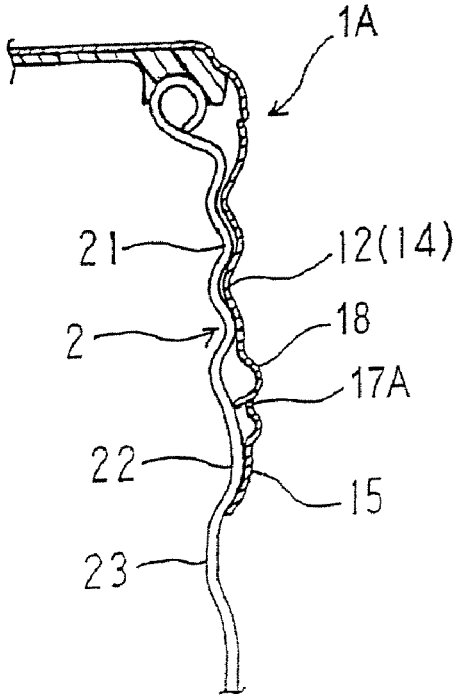
FIG. 9B is a longitudinal section of the same.
Figure 10A:
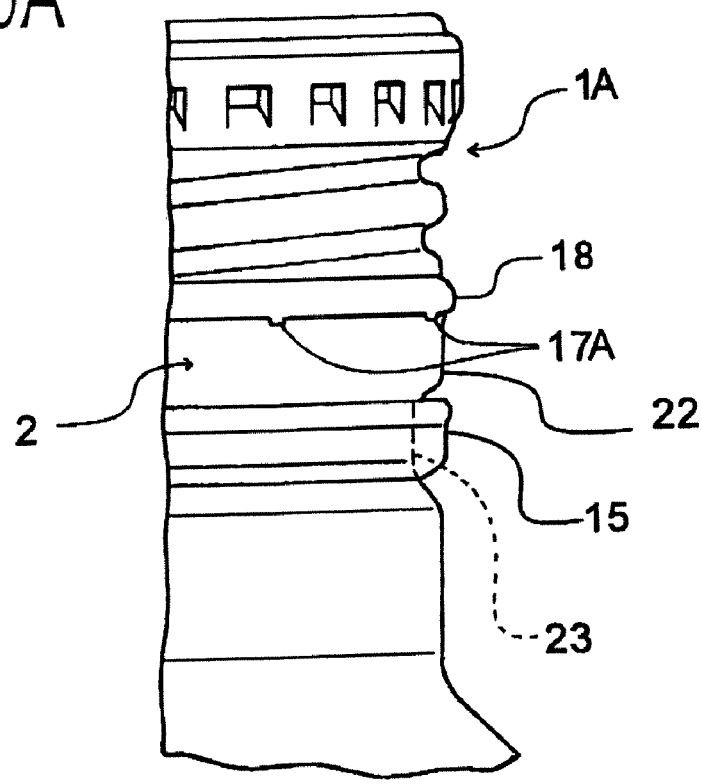
FIG. 10A is a side elevation partially showing the state, in which the container mouth is sealed again with the cap shown in FIG. 6.
Figure 10B:
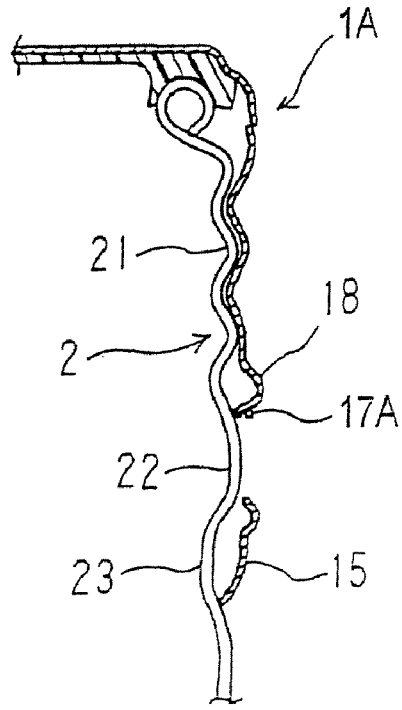
FIG. 10B is a longitudinal section of the same.
Figure 11:
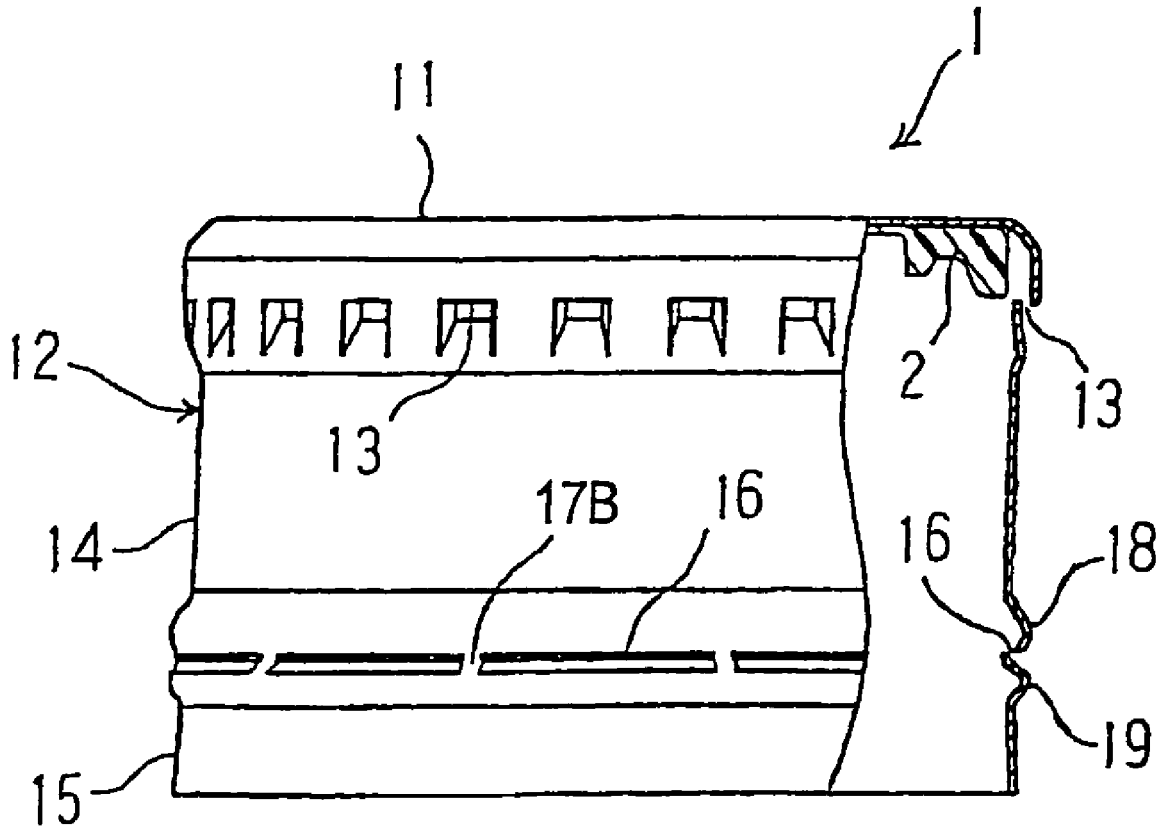
FIG. 11 is a partially cut-away side elevation showing a metallic pilfer-proof cap of the prior art in its unused state before mounted on a container mouth.

FIG. 9 shows the state, in which a cap 1A shown in FIG. 6 is mounted on the container mouth 2. When the cap 1A is turned from this state in a direction to come out of the container mouth 2, the cap 1A is moved upward of FIG. 9 by the screw action. Meanwhile, the lower end portion of the pilfer-proof band 15 in engaging with the lower end portion of the annular bulging portion 22 so that it is prevented from any upward movement. As a result, the bridges 17A are ruptured. Thus, the cap 1A is removed from the container mouth 2 so that the container is opened. On the other hand, the pilfer-proof band 15, which has been cut off the cap 1A but left on the side of the container mouth 2, is not left as it is at its original mounted position on the container mouth 2 but slides down by its own weight to the lower end of the diametrically smaller cylindrical portion 23 which is formed below the annular bulging portion 22. This state is shown in FIG. 10.

Therefore, the pilfer-proof effect of the case, in which the aforementioned cap 1A is fastened on the container mouth 2 to seal the container again, can be attained as with the aforementioned cap 1 shown in FIG. 1. It is like the aforementioned cap 1 shown in FIG. 1 that the lips or the like are not injured by the pilfer-proof band 15.

In addition to this, in the cap 1A shown in FIG. 6, the height of the bridges 17A formed over the shearing plane of the horizontal slits 16A is substantially equal to or smaller than the sheet thickness. When the pilfer-proof band 15 is cut off, therefore, the residues of the bridges 17A on the side of the cap 1A are extremely less than those of the bridges in the cap of the prior art. Moreover, the annular upper bead portion 18 is formed over those bridges 17A so that the residues of the bridges 17A are hidden on the lower side of the upper bead portion 18. When the cap 1A is gripped, therefore, the hand is hardly injured by the residues of the bridges 17A.

The specific examples of the metallic pilfer-proof cap of the invention have been described with reference to the accompanying drawings. However, the invention should not be limited to the individual specific examples thus far described. For example, the invention should not be limited to that cap for a soda beverage container, which is provided with the vent slits in the vicinity of the upper end of the aforementioned skirt portion, but may be extended to the cap, which is simply knurled near the upper end of the skirt portion, or further to a mere suitable design change.

Here, the material for the cap may be a metallic material, preferably such an aluminum alloy sheet having an inner face coated with an epoxy-phenol resin containing olefin resin powder dispersed therein, as has been well known as the metallic material for the cap.

According to the metallic pilfer-proof cap thus far described according to the invention, the pilfer-proof band, as cut off the cap when opened, is not left as it is at the mounted position on the side of the container mouth but is caused to drop down by its own weight. When the container is sealed again after once opened, the clearance can be established between the pilfer-proof band and the cap thereby to provide a sufficient pilfer-proof. At the same time, no residue is left on the side of the pilfer-proof band. When the consumer drinks the beverage from the container mouth through his or her mouth, his or her lips or the like can be prevented from being injured by the pilfer-proof band which might otherwise be left on the side of the container mouth.

Another construction is made to minimize the residues which might otherwise be left on the cap side removed from the container. It is, therefore, possible to prevent the finger reliably from being injured by the residues of the bridge formed on the cap side, when the cap is gripped.

INDUSTRIAL APPLICABILITY

This invention can be effectively utilized in the industries relating to either the manufacture of a re-sealable container such as a bottle-shaped can or a beverage employing a container of that kind.

The invention claimed is:

1. A metallic pilfer-proof cap, comprising:

a skirt portion in which a weakening portion includes horizontal slits and bridges alternately in a circumferential direction of the cap so that a lower portion of the skirt portion can be separated from the skirt portion and can remain as a ring shaped pilfer-proof band around a container mouth when the cap is opened, wherein the horizontal slits are formed by shearing the skirt portion in a transverse direction intermittently from an outside to offset portions above a shearing plane radially inwardly to the cap from a portion below the shearing plane of the horizontal slits, thereby forming the bridges above the shearing plane, an internal diameter of an upper end portion of the pilfer-proof band located below the shearing plane is larger than the maximum external diameter of an annular bulging portion formed at the container mouth, a lower portion of the pilfer-proof band is seamed to fit to the annular bulging portion to prevent the pilfer-proof band from moving upward when the cap is opened, and the pilfer-proof band includes a lower bead portion at the upper end portion thereof below the weakening portion, which protrudes outwardly with respect to a top edge of the pilfer-proof band.

2. A metallic pilfer-proof cap as set forth in claim 1, wherein a portion of said cap above the bridges has a larger diameter than an external diameter of said weakening portion including said bridges.

3. A metallic pilfer-proof cap as set forth in claim 1 or 2, wherein a bridge height of said cap is substantially equal to or smaller than a sheet thickness of the cap.

4. A metallic pilfer-proof cap as set forth in claim 3, wherein the bridge height of said cap is substantially equal to or smaller than the sheet thickness and is larger than 0.07 mm.

* * * * *